United States Patent [19]

Yu

[11] Patent Number: 4,966,377

[45] Date of Patent: Oct. 30, 1990

[54] ROLLER SKATE

[76] Inventor: Chung-Hsiung Yu, 2F, No. 94, Chung-Yuan St., Taipei City, Taiwan

[21] Appl. No.: 394,111

[22] Filed: Aug. 15, 1989

[30] Foreign Application Priority Data

Sep. 30, 1988 [GB] United Kingdom ..... 8822982

[51] Int. Cl.[5] ..... A63C 17/14; A63C 17/04

[52] U.S. Cl. ..... 280/11.2; 280/11.22

[58] Field of Search ..... 280/11.19, 11.2, 11.22, 280/11.23, 11.26, 11.31, 87.41, 87.42

[56] References Cited

U.S. PATENT DOCUMENTS

| | | | |
|---|---|---|---|
| 1,998,236 | 1/1932 | Herold | 188/74 |
| 3,493,085 | 3/1988 | Libhart | 188/74 |

FOREIGN PATENT DOCUMENTS

| | | | |
|---|---|---|---|
| 263555 | 9/1912 | Fed. Rep. of Germany . | |
| 240229 | 12/1940 | Fed. Rep. of Germany . | |
| 31186 | 8/1984 | Fed. Rep. of Germany | 280/11.22 |
| 1254876 | 5/1961 | France . | |
| 2181896 | 7/1973 | France . | |
| 2302114 | 8/1978 | France . | |
| 96483 | 3/1922 | Switzerland . | |

*Primary Examiner*—Charles A. Marmor
*Assistant Examiner*—Richard Lamb
*Attorney, Agent, or Firm*—Ladas & Parry

[57] ABSTRACT

A roller skate includes at least one front roller, a middle roller longitudinally aligned with the front roller, and a pair of rear rollers. The lowest point of the front roller is substantially higher than the middle roller and the pair of rear rollers to that a skater can skate only with the front roller and the middle roller. Alternatively, a hinge member connects pivotally the front portion and the middle portion of the roller skate so that the pair of rear rollers can be lifted up, thereby, allowing the skater to skate only with the front roller and the middle roller. In this way, the skater can gyrate smoothly at a radius smaller than that of a conventional roller skate.

10 Claims, 3 Drawing Sheets

ROLLER SKATE

BACKGROUND OF THE INVENTION

This invention relates to a roller skate. More particularly, this invention relates to a roller skate comprising at least two longitudinally aligned front and middle rollers so that it may be operable in a manner resembling an ice skate.

A conventional roller skate having two pairs of transversely aligned rollers is more stable than an ice skate equipped with a single runner when the skater is standing. However, the radius of gyration of the roller skate is greater than that of the ice skate. As a result, the roller skate can not gyrate as fast as the ice skate. It is more difficult to control the direction of gyration of a roller skate when a skater tries to gyrate with a smaller radius of gyration.

SUMMARY OF THE INVENTION

Accordingly, the main object of this invention is to provide a roller skate having at least two longitudinally aligned front and middle rollers so that said roller skate can enjoy a smaller radius of gyration by only using said two longitudinally aligned rollers, thus gyrating both quickly and smoothly.

It is another object of this invention to provide a roller skate having less surface area in contact with the ground so as to enable the skater to skate faster than he/her would be able to with conventional skates.

It is a further object of this invention to provide two sets of braking means, one set respectively fixed on two sides of said front roller, and another set fixed in front of said longitudinally aligned front and said middle rollers, the combined effect of these breaking means enabling said roller skate can accelerate conveniently.

It is also a feature of this invention that a skater can skate only by means of said front roller and middle roller of said roller skate.

It is yet another feature of this invention that said front roller, which is supported under the front portion of the roller skate, is suspended in the air while said middle roller and a pair of transversely aligned rear rollers of the skate are placed on a horizontal surface.

Therefore, the roller skate of this invention comprises:

a substantially plain shoe base generally having a front portion, a rear portion, and a middle portion connected between said front portion to said rear portion;

a pair of transversely aligned rear rollers rotatably supported under said rear portion;

at least one middle roller rotatably supported under said middle portion of said shoe base, said middle roller being disposed at a position constituting the vertex of an isosceles triangle formed by said middle roller and said pair of rear rollers, thus constructing a supporting plane for making contact with the ground; and at least one front roller rotatably supported under said front portion of said shoe base, being longitudinally aligned with said middle roller.

Said front roller possibly disposed at a position wherein its lowest point is substantially higher than said supporting plane, while said supporting plane is in contact with a horizontal surface. Whereby said roller skate can skate only with said front roller and said middle roller allowing fast and smooth gyration. In addition, said roller skate can also be operated using only said middle roller and said pair of rear rollers so that said roller skate has a minimized surface area in contact with the ground and thus can skate faster than conventional roller skates.

The roller skate of this invention also has two sets of longitudinally aligned braking means, one said being fixed under said front portion, and another set fixed in front of said front and middle rollers so as to enable the skater to accelerate conveniently.

BRIEF DESCRIPTION OF THE DRAWINGS

The foregoing objects and features of this invention are explained in the following description, taken in connection with the accompanying drawings wherein.

DETAILED DESCRIPTION OF THE PREFERRED EMBODIMENTS

Figure 1:
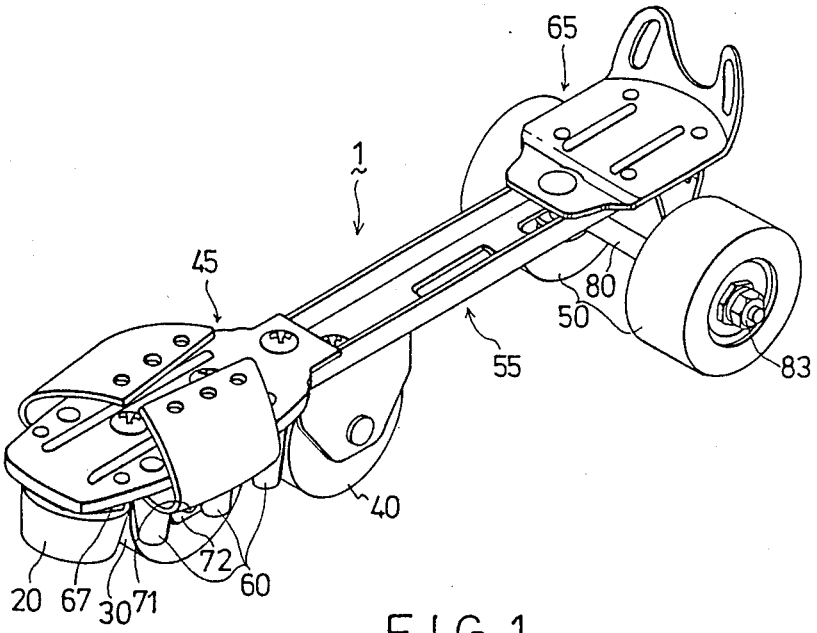
FIG. 1 is a perspective view of a preferred embodiment of a roller skate in accordance with this invention.

Referring to FIG. 1, a preferred embodiment of a roller skate comprises a substantially plain shoe base 1 adapted to fit with a foot and fix a foot thereon, a toe stop 20, two lines of braking means, substantially being rubber stoppers 60, a front roller 30, a middle roller 40 being longitudinally aligned with said front roller 30, and a pair of transversely aligned rear rollers 50.

Figure 2:
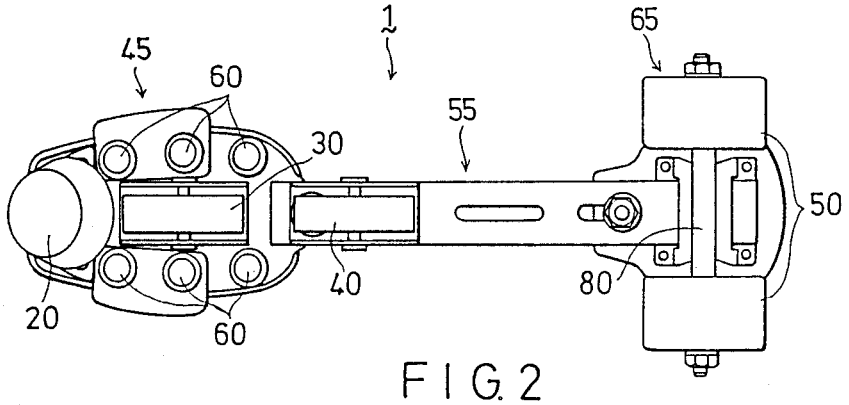
FIG. 2 is a bottom view of a preferred embodiment of a roller skate in accordance with this invention.

Referring to FIGS. 1, 2, said substantially plain shoe base 1 comprises a front portion 45, a middle portion 55, and a rear portion 65. Said middle portion 55 is slidably and adjustably connected between said front portion 45 and said rear portion 65 so as to enable the length of the she base to very to adapt to different foot sizes. Said toe stop 20 is fixed on a base 67 connected under the front end of said shoe base 1 by a rivet or a screw. Said two lines of rubber stoppers 60 are respectively fixed under two opposite sides of said front portion 45. Each set of rubber stoppers is longitudinally aligned and parallel to said front roller 45 and said middle roller 55.

Said front roller 45 is rotatably supported under said front portion 45 by a roller seat 72 which has an axle 71 passing through the center of said front roller 45. Said roller seat is connected to said front portion 45 by a rivet or a screw. Said middle roller 40 is rotatably supported in a similar manner to said front roller 30 under said middle portion 55. Said middle roller 40 is disposed near said front roller 30 at a position constituting the vertex of an isosceles triangle, formed by said middle roller 40 and said pair of rear rollers 50. In this way, said middle roller 40 and said pair of rear roller 50 construct a supporting plane for making contact with the ground allowing said roller skate to be operated like a conventional skate. Said pair of transversely aligned rear rollers 50 are passed through at their centers by an axle 83 and rotatably mounted to two ends of said axle 83. Said axle is supported and connected by a V-type roller seat 80. Said V-type roller seat is fixed under said rear portion 65 by a rivet or a screw.

Figure 3:
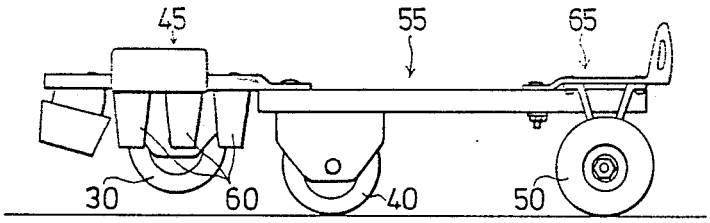
FIG. 3 is a side view of a preferred embodiment of a roller skate in accordance with this invention.
Figure 4:
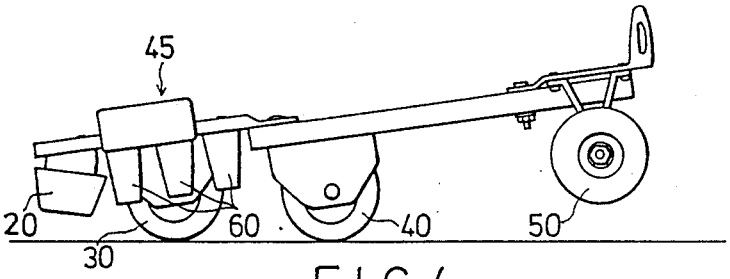
FIG. 4 is a schematic view of a preferred embodiment of a roller skate of this invention in an operating position.

Referring to FIG. 3, a side view of a preferred embodiment is shown wherein said front portion 45 is in an elevated position whereby said front roller 30 is suspended in the air at a predetermined height while said middle roller 40 and said pair of rear rollers 50, which have the same diameter as said front roller 30, are placed on the ground. As said front portion 45 is pressed down by the skater, such that front roller 30 and said middle roller 40 are in contact with the ground, said pair of rear rollers are lifted above the ground, as shown in FIG. 4. In this way, the roller skate can be operated in a manner resembling an ice skate with two longitudinally aligned rollers, (i.e. said front roller 30 and said middle roller 40), enjoying a small radius of gyration.

Figure 5:
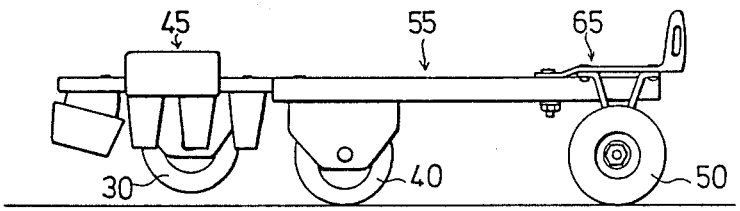
FIG. 5 is a side view of another preferred embodiment of a roller skate in accordance with this invention.
Figure 6:
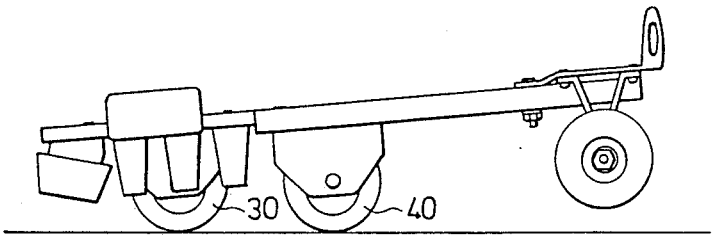
FIGS. 6 to 8 are schematic views of another preferred embodiment of a roller skate of this invention in an operating position.

Referring to FIG. 5, a side view of another preferred embodiment shows that said front portion 45 is as high as said middle portion 55, but said front roller 30 is smaller than said middle roller 40. In this case, said front roller 30 will be suspended in the air and this alternative embodiment of a roller skate shown in FIG. 4 will operate in the same manner as the roller skate shown in FIG. 6.

Figure 7:
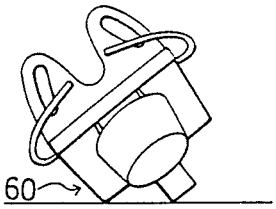
Figure 8:
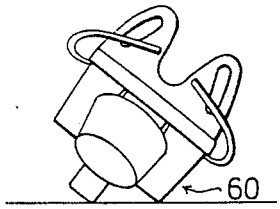

Referring to FIGS. 7 and 8, if a roller skate in accordance with this invention gyrates with a radius of gyration too small for the skater, one of said two rubber stoppers 60 will come into contact with the ground so as to reduce the speed. Therefore, the skater can be prevented from falling due to a loss of balance. In addition, a skater can accelerate by means of pressing down on said rubber stoppers 60 with his or her feet, in order to produce a reactive force.

Figure 9:
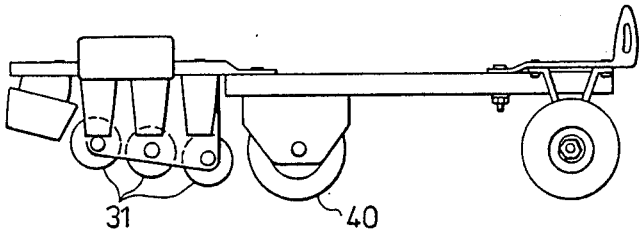
FIG. 9 is alternative preferred embodiment of a roller skate in accordance with this invention.

Referring to FIG. 9, still another preferred embodiment of a roller skate is shown wherein a series of front rollers 31 are longitudinally aligned with said middle roller 40. Said series of front rollers 31, which are smaller than said middle roller 40, function much like said front roller 30, shown in FIG. 5. When skating with said series of front rollers 31 and said middle roller 40, in a manner resembling ice skating, the skater can skate more stably and still enjoy the same effects of the abovementioned front roller 30.

Figure 10:
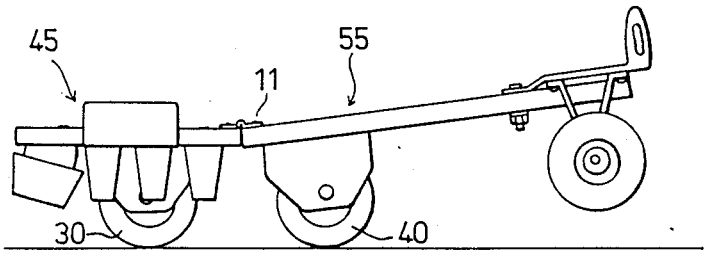
FIG. 10 is a schematic view of a further preferred embodiment of a roller skate in accordance with this invention in an operating position.

Referring to FIG. 10, a further preferred embodiment of a roller skate is shown wherein a hinge member 11 connecting pivotally said front portion 45 and said middle portion 55, enables said pair of rear rollers 50 of said rear portion 65 to be lifted up so that the skater can skate with only said front roller 30 and said middle roller 40, which have same diameter, without the need to elevate said front portion 45 or reduce the diameter of said front roller 30.

The above embodiments are given by way of example only. Various modifications will be apparent to persons skilled in the art without departing from the scope of the invention defined by the appended claims.

I claim:

1. A roller skate comprising:

a shoe base having a front portion, a rear portion, and a middle portion connected between said front portion and said rear portion;

a pair of transversely aligned rear rollers rotatably supported under said rear portion;

at least one middle roller rotatably supported under said middle portion, said middle roller being disposed at a position constituting the vertex of an isosceles triangle formed by said middle roller and said pair of rear rollers, thus constructing a supporting plane for making contact with the ground; and a series of rollers having a smaller diameter than said middle roller so that the lowest point of said series of rollers is substantially higher than said supporting plane, while said supporting plane is in contact with a horizontal surface, said series of rollers rotatably supported under said front portion of said shoe base and longitudinally aligned with said middle roller.

2. A roller skate as claimed in claim 1, wherein said front portion of the shoe base is elevated to that the lowest point of said series of rollers is substantially higher than said supporting plane.

3. A roller skate as claimed in claim 1 further comprising a hinge member which connects pivotally said front portion and said middle portion, enabling said pair of rear rollers to be lifted up so that the lowest position of said pair of rear rollers is substantially higher than said series of rollers and said middle roller, while said series of rollers and said middle roller are in contact with a horizontal surface.

4. A roller skate as claimed in claim 1 further comprising a first braking means fixed under said front portion and adjacent to at least one side of said front roller, and a second braking means fixed under said front portion, in front of said front roller.

5. A roller skate comprising:

a shoe base having a front portion, a rear portion, and a middle portion connected between said front and said rear portion;

a pair of transversely aligned rear rollers rotatably supported under said rear portion;

at least one middle roller rotatably supported under said middle portion, said middle roller being disposed at a position constituting the vertex of an isosceles triangle formed by said middle roller and said pair of rear rollers, thus constructing a supporting plane for making contact with the ground;

at least one front roller rotatably supported under said front portion of said shoe base and longitudinally aligned with said middle roller;

a first braking means fixed under said front portion and adjacent to at least one side of said front roller; and a second braking means fixed under said front portion, in front of said front roller.

6. The roller skate according to claim 4, wherein said first braking means comprises two sets of rubber stoppers with each set positioned on the sides of said front roller in parallel to said front and middle rollers.

7. The roller skate according to claim 5, wherein said front roller has a smaller diameter than said middle roller so that the lowest point of said front roller is substantially higher than said supporting plane, while said supporting plane is in contact with a horizontal surface.

8. The roller skate according to claim 5, wherein said front roller and middle roller have the same diameter and said front portion of the shoe base is elevated so that the lowest point of said front roller is substantially higher than said supporting plane.

9. The roller skate according to claim 5, further comprising a hinge member which connects pivotally said front portion and said middle portion, enabling said pair of rear rollers to be lifted up so that the lowest position of said pair of rear rollers is substantially higher than said front roller and said middle roller, while said front roller and said middle roller are in contact with a horizontal surface.

10. The roller skate according to claim 5, wherein said first braking means comprises two sets of rubber supports with each set positioned on the sides of said front roller in parallel to said front and middle rollers.

* * * * *